US010088272B2

(12) United States Patent
Echevarria

(10) Patent No.: US 10,088,272 B2
(45) Date of Patent: Oct. 2, 2018

(54) SINGLE POINT TACTICAL SLING AND HANDS FREE CARRYING DEVICE

(71) Applicant: Javier R. Echevarria, Morgan Hill, CA (US)

(72) Inventor: Javier R. Echevarria, Morgan Hill, CA (US)

(73) Assignee: Sara L. Colby, Morgan Hill, CA (US)

( * ) Notice: Subject to any disclaimer, the term of this patent is extended or adjusted under 35 U.S.C. 154(b) by 20 days.

(21) Appl. No.: 14/569,684

(22) Filed: Dec. 13, 2014

(65) Prior Publication Data

US 2015/0168097 A1 Jun. 18, 2015

Related U.S. Application Data

(60) Provisional application No. 61/916,057, filed on Dec. 13, 2013.

(51) Int. Cl.
*F41C 33/00* (2006.01)
*F41C 23/02* (2006.01)

(52) U.S. Cl.
CPC ..... *F41C 33/002* (2013.01); *F41C 23/02* (2013.01); *F41C 33/001* (2013.01)

(58) Field of Classification Search
CPC .. F41C 33/001–33/003; F41C 33/005–33/008; F41C 33/041; F41C 33/046; F41C 23/02; A45F 2200/0591
USPC ..... 224/149–150, 913; 42/85
See application file for complete search history.

(56) References Cited

U.S. PATENT DOCUMENTS 1,198,202 A 9/1916 Drinkard
3,258,182 A 6/1966 McDonald
4,498,613 A * 2/1985 Donahue ..... A61J 9/06 224/148.4
4,555,051 A 11/1985 Johnson
(Continued)

FOREIGN PATENT DOCUMENTS

GB 113515 2/1918

OTHER PUBLICATIONS

International Search Report for PCT/US2014/070189, Mar. 1, 2015, 4 pages, ISA/IL.

(Continued)

*Primary Examiner* — Scott McNurlen
(74) *Attorney, Agent, or Firm* — Mnemoglyphics, LLC; Lawrence M. Mennemeier

(57) ABSTRACT

Disclosed methods, systems, and apparatus provide multiple-position slings and hands-free carrying devices for equipment, hand guns, shoulder weapons, military-style tactical firearms, etc. Systems include adjustably attaching into a garment, a single-point sling with a slider strap and slider for repositioning a detachable lanyard, e.g. to attach a shoulder weapon. Methods for using systems for a single-point sling for a long gun, include holstering the gun supported by a loop of the lanyard detachably attached to the slider in a front-holstering position, e.g. at a user's secondary side under the arm. Embodiments include drawing the long gun forward, the loop of the lanyard supporting the long gun proximate a stock, grip or single-point receiver plate mount of the long gun, and shouldering the gun with the stock against a shoulder, the slider positioned at a shooting position of the slider strap of the single-point sling system.

25 Claims, 16 Drawing Sheets

(56) References Cited

U.S. PATENT DOCUMENTS

| | | | | |
|---|---|---|---|---|
| 4,571,872 | A | 2/1986 | Johnson | |
| 4,823,998 | A | 4/1989 | Johnson | |
| 5,038,987 | A | 8/1991 | Huddleston | |
| 5,134,797 | A * | 8/1992 | Turner | F41C 33/00 42/85 |
| 5,433,360 | A | 7/1995 | Rock | |
| 5,669,170 | A * | 9/1997 | Norris | F41C 33/00 224/150 |
| 5,881,487 | A | 3/1999 | Chalker | |
| 5,971,239 | A | 10/1999 | Marable | |
| 6,068,167 | A | 5/2000 | Hopson | |
| 6,295,650 | B1 * | 10/2001 | Baacke | A41D 13/0012 2/462 |
| 7,048,161 | B2 | 5/2006 | George | |
| 7,059,502 | B2 | 6/2006 | Johnson | |
| 7,082,709 | B2 | 8/2006 | Lindsey | |
| 2003/0213823 | A1 * | 11/2003 | Papovitch | A45F 5/02 224/254 |
| 2004/0200866 | A1 | 10/2004 | Walters, Jr. | |
| 2006/0011677 | A1 | 1/2006 | Burnsed et al. | |
| 2006/0208016 | A1 | 9/2006 | Esch | |
| 2008/0217371 | A1 | 9/2008 | Wemmer | |
| 2010/0206921 | A1 * | 8/2010 | Shen | F41C 33/002 224/150 |
| 2011/0017788 | A1 | 1/2011 | Haley et al. | |
| 2011/0093996 | A1 | 4/2011 | Henriquez | |
| 2011/0138671 | A1 | 6/2011 | Rogers et al. | |
| 2012/0280006 | A1 * | 11/2012 | Garrett | F41C 33/002 224/150 |
| 2013/0025178 | A1 | 1/2013 | Blitch | |
| 2013/0101280 | A1 * | 4/2013 | Xu | G03B 17/563 396/423 |

OTHER PUBLICATIONS

Written Opinion of the International Searching Authority for PCT/US2014/070189, Mar. 1, 2015, 6 pages, ISA/IL.

* cited by examiner

SINGLE POINT TACTICAL SLING AND HANDS FREE CARRYING DEVICE

CROSS REFERENCE TO RELATED APPLICATIONS

Pursuant to the provisions of 35 U.S.C. § 119(e), this application claims priority to U.S. Provisional Patent Application Ser. No. 61/916,057, which was filed Dec. 13, 2013, the entire contents of which are incorporated herein by reference.

FIELD OF THE DISCLOSURE

This disclosure generally relates to slings and hands free carrying devices. In particular, the disclosure relates to methods, systems, and apparatus for providing multiple position slings and hands free carrying devices for equipment, hand guns, long guns, shoulder weapons and military style tactical firearms or other devices.

BACKGROUND OF THE DISCLOSURE

When one wants to carry and/or shoulder a weapon, in particular a long gun, a sling may be used to support the weapon in a position or positions that do not require both hands to hold the weapon. Typically a rifle sling will provide for carrying the weapon in front of a user or in back of the user. But a weapon positioned in front of the user may inhibit the user's mobility, and clothing articles such as coats or jackets may interfere with, or may be cause for additional concern with regard to the weapon's alternative carrying positions, e.g. in back of the user.

To date, more options for carrying and/or shouldering a weapon, in particular a long gun have not been fully explored.

BRIEF DESCRIPTION OF THE DRAWINGS

The present invention is illustrated by way of example and not limitation in the figures of the accompanying drawings.

DETAILED DESCRIPTION

The following description discloses methods, systems, and apparatus provide multiple-position slings and hands-free carrying devices for equipment, hand guns, long guns, shoulder weapons and military style tactical firearms or other devices. Embodiments of disclosed systems include adjustably attaching into a garment, a single-point sling with a slider strap and slider for repositioning a detachable lanyard, e.g. to attach a shoulder weapon. Methods for using embodiments of disclosed single-point sling systems for a long gun, include holstering the gun supported by a loop of the lanyard detachably attached to the slider in a front-holstering position, e.g. at secondary side of the user under the arm. Embodiments include drawing the long gun forward, the loop of the lanyard supporting the long gun proximate a stock, grip or single-point receiver plate mount of the long gun, and shouldering the gun with the stock against a shoulder of the user, the slider positioned at a shooting position of the slider strap of the single-point sling system.

Embodiments of the systems and apparatus herein disclosed for a long gun single point sling may be used to facilitate concealed carry of a shoulder weapon or long gun under a coat or jacket of a user. Embodiments of systems and apparatus herein disclosed may provide for holstering of a long gun in a hands-free carrying position on the back behind the wearer's shoulder. Some embodiments of the systems and apparatus for a long gun single point sling may support cross-draw capabilities of the user. Some embodiments of the systems and apparatus herein disclosed may also serve as functional suspenders to support the weight of a duty belt. Some embodiments of systems and apparatus herein disclosed for a long gun single point sling may be sewn into or otherwise integrated into a coat, vest or jacket and therefore, may also provide for holstering of the shoulder weapon or long gun at a hands-free carrying position on the back of the coat, vest or jacket behind the wearer's shoulder. It will also be appreciated that through embodiments of systems and apparatus herein disclosed for a long gun single point sling, a uniform process for using some variety of shoulder weapons and/or long guns may be established.

In the following description, numerous specific details such as multiple-position slings and hands-free carrying devices, detachable lanyards having swivels of flexible materials coupled to a keeper, quick release attachment mechanism, and the like are set forth in order to provide a more thorough understanding of embodiments of the present invention. It will be appreciated, however, by one skilled in the art that the invention may be practiced without such specific details. Additionally, some well known structures, and the like have not been shown in detail to avoid unnecessarily obscuring embodiments of the present invention.

Figure 1A:
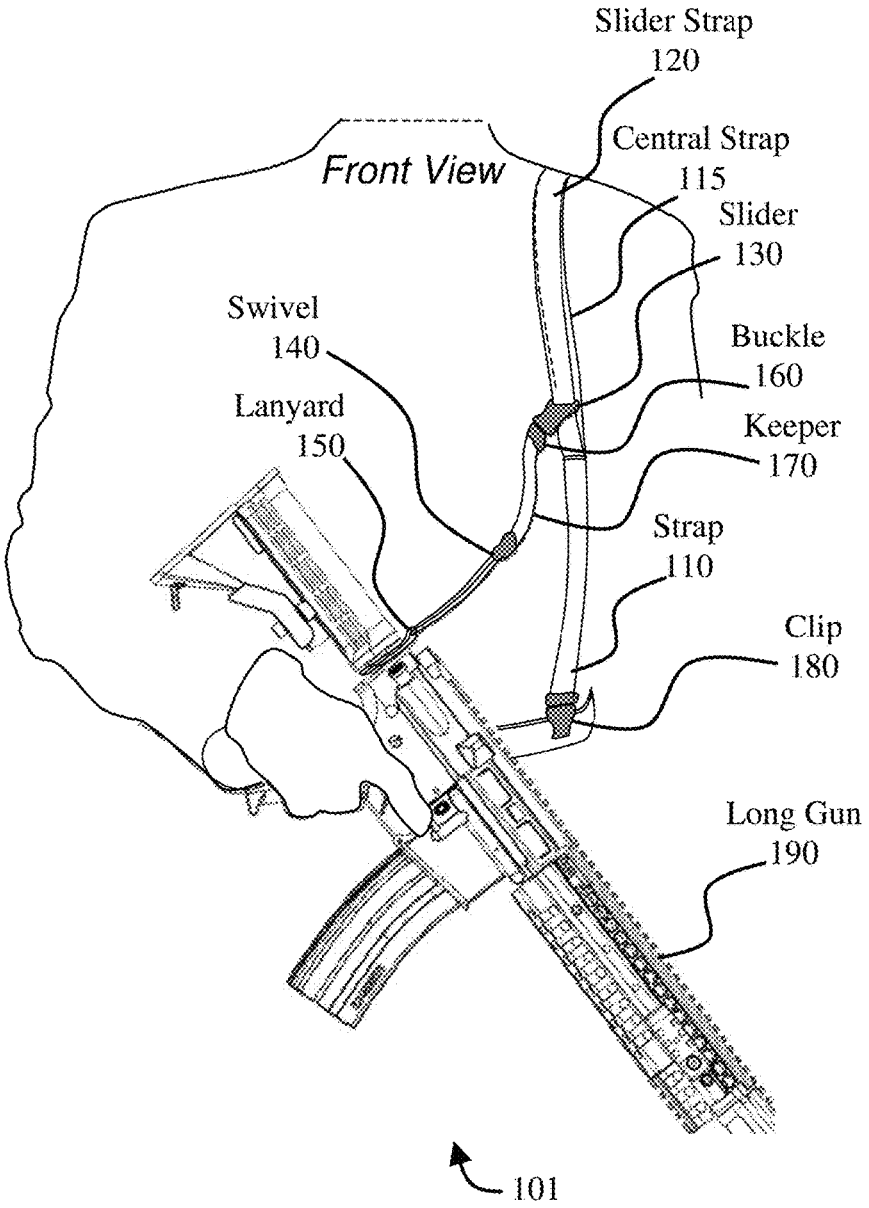
FIG. 1A illustrates one embodiment of a system for a shoulder weapon or long gun single point sling.

FIG. 1A illustrates one embodiment of a system 101 for a shoulder weapon or long gun single point sling. The system 101 comprises an elongate extendible first strap portion 110 having an extendible first end and a first end attachment mechanism (e.g. clip 180) coupled with said extendible first end for detachably attaching first strap portion 110 proximate a front belt loop on a support side of a wearer. Embodiments of the system 101 may also comprise an elongate central strap portion 115 interconnected with said first strap portion 110. A slider strap 120 is attached to the first strap portion 110 (e.g. via central strap portion 115) at a first point proximate the wearer's shoulder and at a second point proximate the wearer's chest. In some embodiments central strap portion 115 may comprise a plastic covered nylon such as BIOTHANE coated webbing as a non-slip backing (BioThane® is a registered trademark of BioThane Coated Webbing). A slider 130 is functionally coupled to slider strap 120 for detachably attaching (e.g. via buckle 160) to a lanyard 150 and for repositioning lanyard 150 on the slider strap 120 between said first point and said second point.

Embodiments of a detachable lanyard 150 may also comprise a length of flexible material in the form of a loop to attach the detachable lanyard to a shoulder weapon or long gun 190 proximate a stock of the shoulder weapon or long gun 190. A swivel 140 is coupled with the length of flexible material, wherein said length of flexible material in some embodiments is being deployed through a flexible tubing conduit (e.g. as shown below in FIG. 8, 845). A keeper 170 is coupled to the swivel 140. A quick release attachment mechanism (e.g. buckle 160) is coupled with keeper 170 for detachably attaching the detachable lanyard 150 to slider 130 of a sling.

Figure 1B:
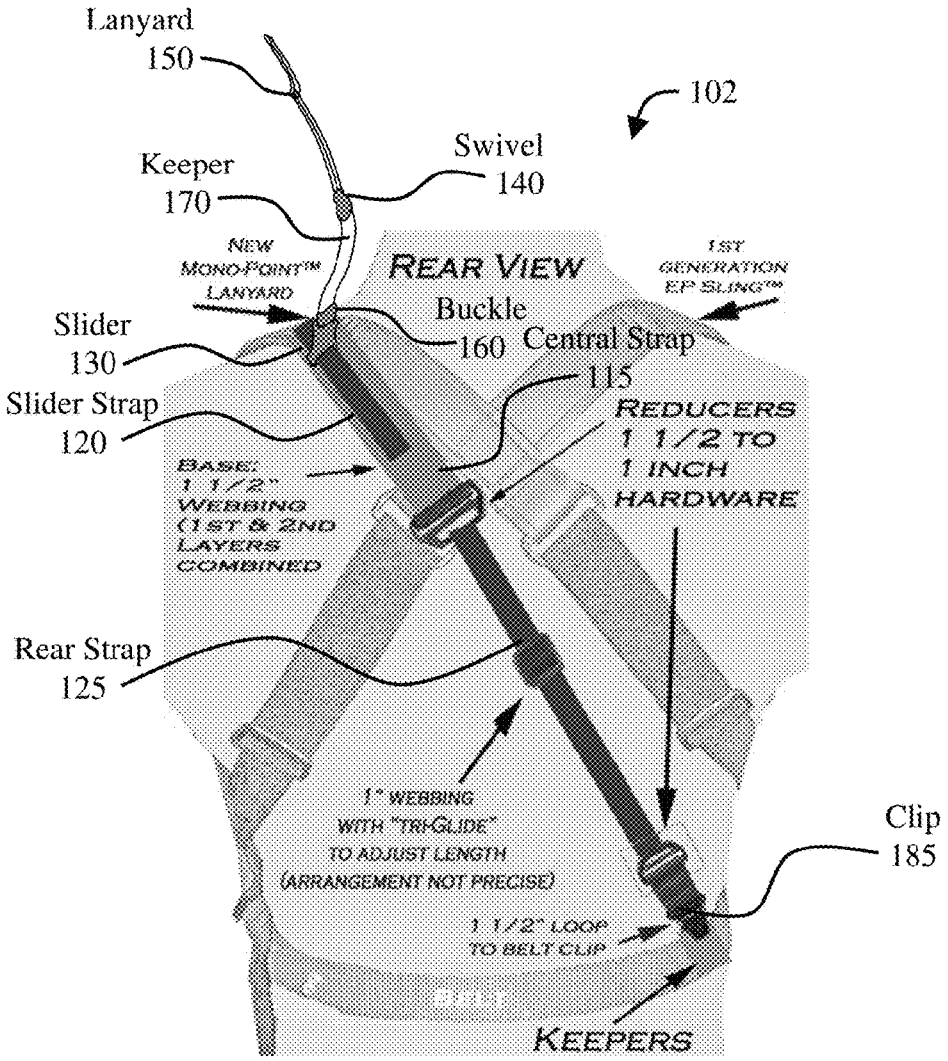
FIG. 1B illustrates rear view alternative embodiments of a system for a shoulder weapon or long gun single point sling.

FIG. 1B illustrates rear view alternative embodiments of a system 102 for a shoulder weapon or long gun single point sling. Embodiments of the system 102 may also further comprise an elongate extendible rear second strap portion 125 having a fixed end and an extendible second end, a first length portion extending from said fixed end to said extendible second end and a second end attachment mechanism 185 coupled with the extendible second end for detachably attaching second strap portion 125 proximate a back belt loop on a strong side of the wearer.

Embodiments of the systems 101 and/or 102 may also comprise an elongate central strap portion 115 (or shoulder strap portion) interconnected with rear second strap portion 125 and front first strap portion 110 between rear second strap portion 125 and front first strap portion 110, to be positioned proximate the wearer's chest and shoulder. Slider strap 120 is attached to the second strap portion 125 (e.g. via central strap portion 115) at the wearer's chest and shoulder. Slider 130 is functionally coupled to slider strap 120 for detachably attaching (e.g. via buckle 160) to a lanyard 150 and for repositioning lanyard 150 on the slider strap 120 between the wearer's chest and shoulder. In some embodiments the systems 102, the central strap portion 115 (or shoulder strap portion) may also be one of the shoulder straps of a back crossing pair of shoulder straps of a hands-free carrying apparatus.

It will be appreciated that embodiments of the systems 101 and/or 102 may provide for holstering of a long gun in a hands-free carrying position on the back behind the wearer's shoulder. It will also be appreciated that some embodiments of the systems 101 and/or 102 may also serve as functional suspenders to support the weight of a duty belt.

Figure 2:
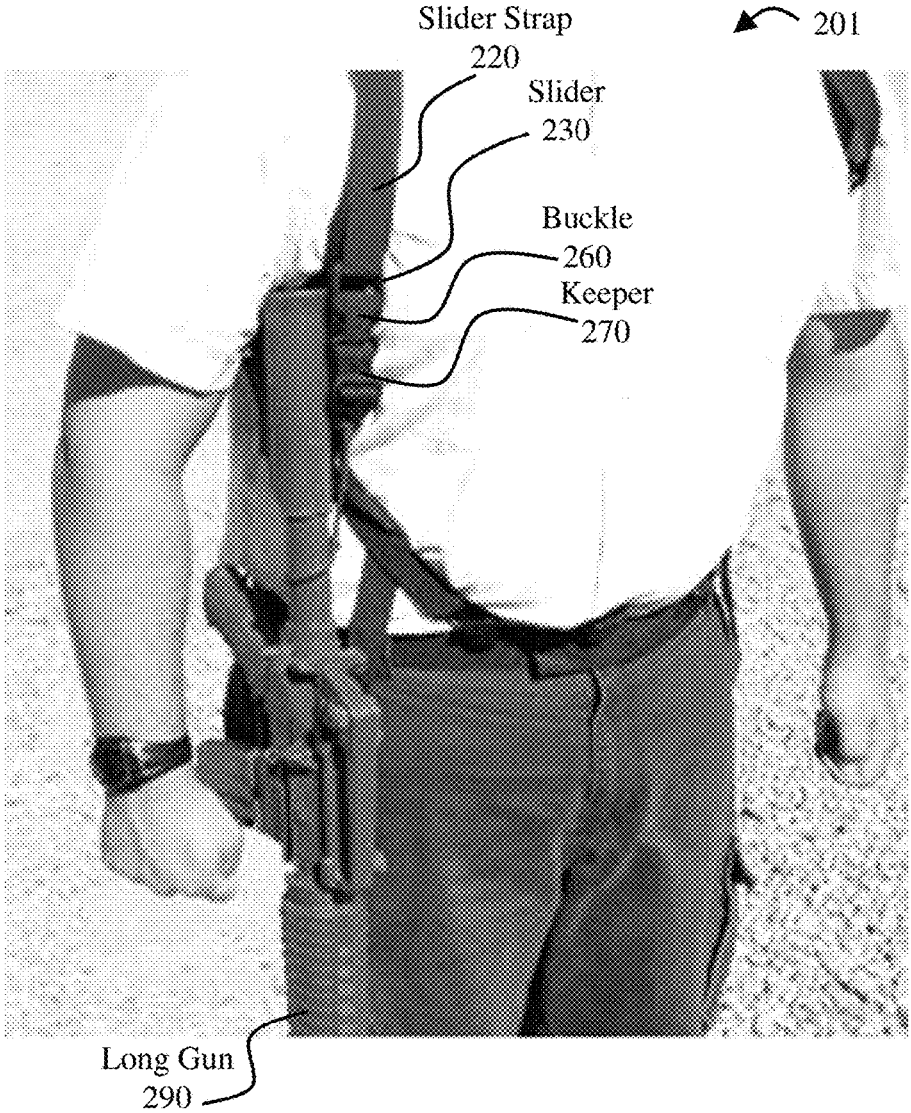
FIG. 2 illustrates another embodiment of a system for a shoulder weapon or long gun single point sling.

FIG. 2 illustrates another embodiment of a system 201 for a shoulder weapon or long gun 290 single point sling. In some embodiments the system 201 may be combined with or integrated into system 101 and/or system 102. Embodiments of the system 201 may also further comprise a second slider strap 220 attached to an other one of the shoulder straps at a third point proximate the wearer's shoulder and at a fourth point proximate the wearer's chest on an opposite side of the wearer. A second slider 230 is functionally coupled to second slider strap 220 for detachably attaching (e.g. via buckle 260 coupled to keeper 270) to a second holder (e.g. lanyard 850 as described below with regard to FIG. 8) for repositioning the second holder on the second slider strap 220 between said third point proximate the wearer's shoulder and said fourth point proximate the wearer's chest on an opposite side of the wearer.

Figure 3A:
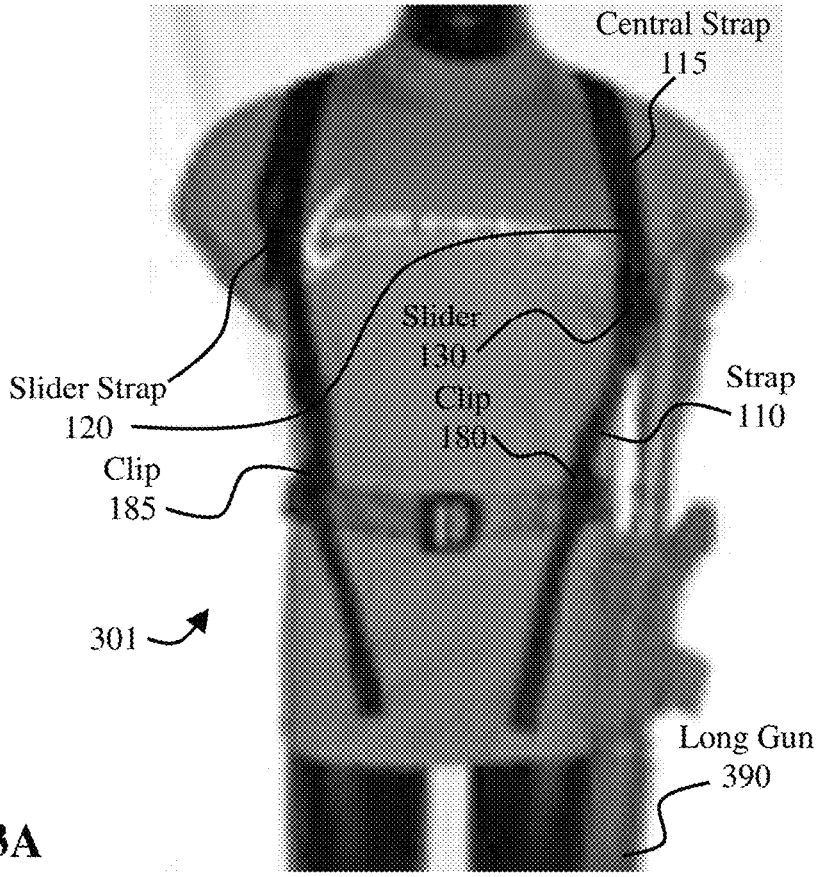
FIG. 3A illustrates a front view of another embodiment of a system for a shoulder weapon or long gun single point sling.
Figure 3B:
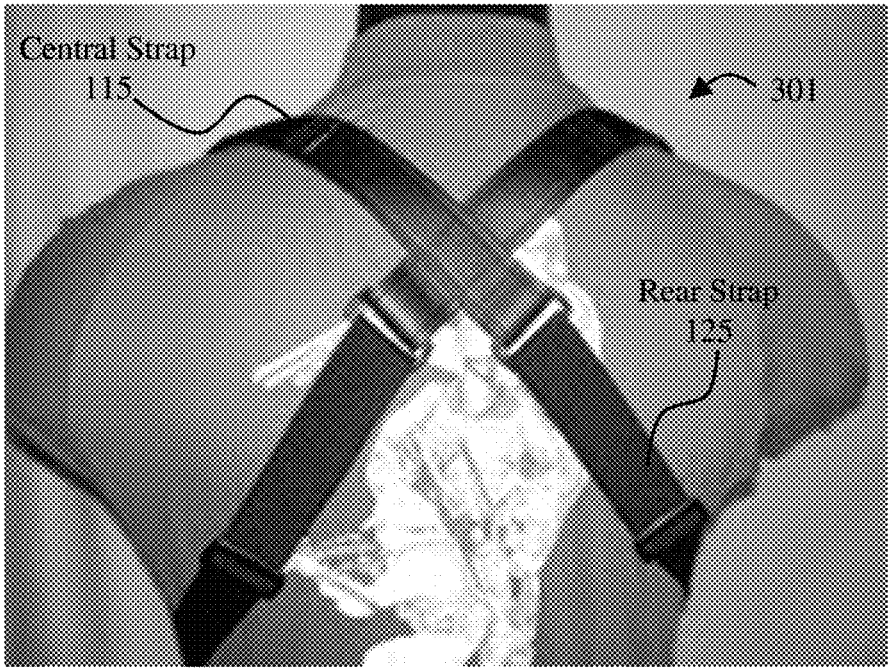
FIG. 3B illustrates a rear view of another embodiment of a system for a shoulder weapon or long gun single point sling.

FIG. 3A illustrates a front view of another embodiment of a system 301 for a shoulder weapon or long gun 390 single point sling. The system 301 comprises an elongate extendible first strap portion 110 having an extendible first end and a first end attachment mechanism (e.g. clip 180) coupled with said extendible first end for detachably attaching first strap portion 110 proximate a front belt loop on a support side of a wearer. Embodiments of the system 301 may also comprise an elongate central strap portion 115 (or shoulder strap portion) interconnected with said first strap portion 110. In some embodiments of the system 301, the central strap portion 115 (or shoulder strap portion) may also be one of the shoulder straps of a rear torso crossing shoulder strap portion (e.g. as shown in FIG. 3B) of a system for a single point sling or hands-free carrying apparatus. A second end attachment mechanism (e.g. clip 185) is coupled with an extendible second end for detachably attaching the shoulder strap portion proximate a belt loop on a strong side of the wearer.

A slider strap 120 is attached to the first strap portion 110 (e.g. via central strap portion 115) at a first point proximate the wearer's shoulder and at a second point proximate the wearer's chest. A slider 130 is functionally coupled to slider strap 120 for detachably attaching (e.g. via buckle 160) to a lanyard (e.g. lanyard 150) and for repositioning the lanyard on the slider strap 120 between said first point proximate the wearer's shoulder and said second point proximate the wearer's chest.

FIG. 3B illustrates a rear view of another embodiment of a system 301 for a shoulder weapon or long gun single point sling. A rear torso crossing shoulder strap portion comprises as one of the shoulder straps the central strap portion 115. Embodiments of the system 301 may also further comprise an elongate extendible rear second strap portion 125 having a fixed end, an extendible second end and second end attachment mechanism (e.g. clip 185) for detachably attaching said shoulder strap portion proximate a belt loop on a strong side of the wearer (e.g. as seen in FIG. 3A).

Figure 3C:
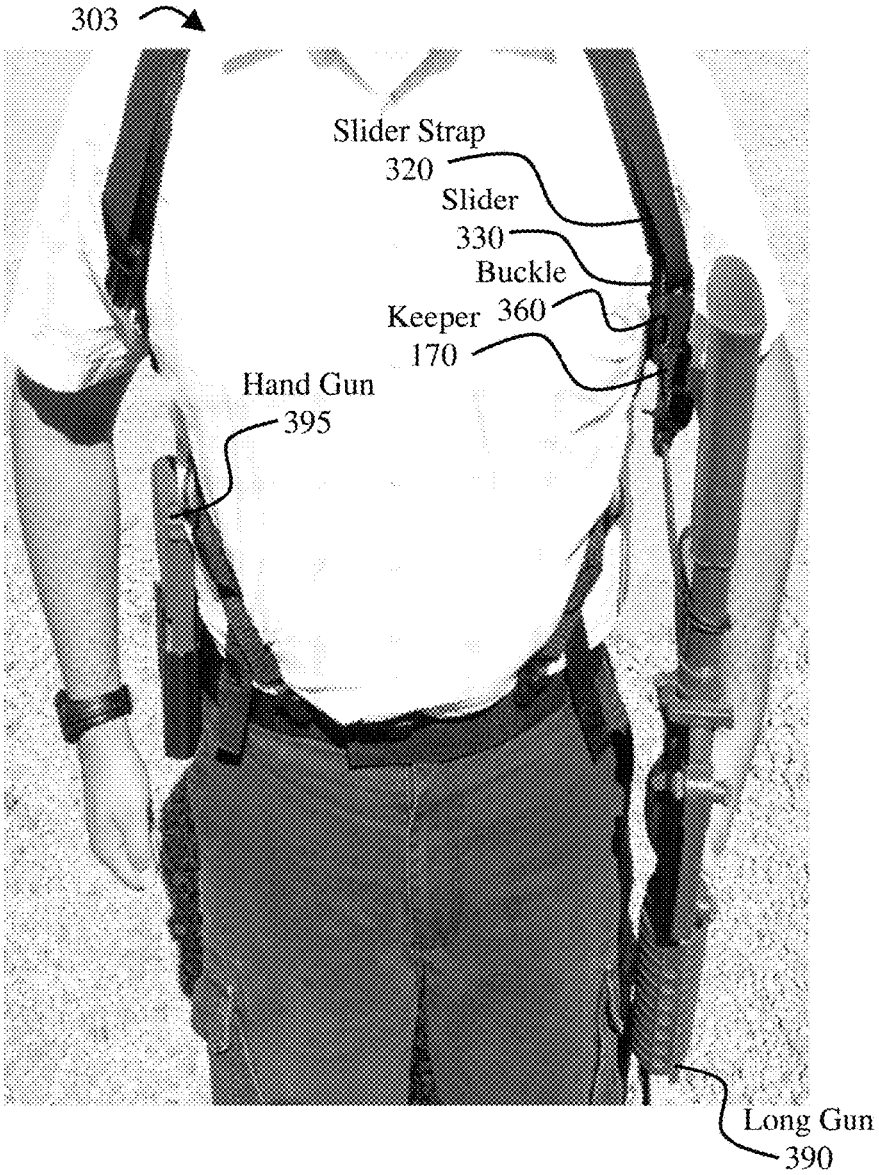
FIG. 3C illustrates an alternative front view of another embodiment of a system for a shoulder weapon or long gun single point sling.

FIG. 3C illustrates an alternative front view of another embodiment of a system 303 for a shoulder weapon or long gun 390 single point sling apparatus. The system 303 comprises a back crossing pair of shoulder straps (not shown in this view) with a first slider strap 320 attached to one of the shoulder straps at a first point proximate a wearer's shoulder and at a second point proximate the wearer's chest. A slider 330 is coupled to the first slider strap 320 and a quick release attachment mechanism (e.g. buckle 360) coupled with keeper 170 for detachably attaching a holder and for repositioning said holder on the slider strap 320 between said first and said second points. A second slider strap (e.g. slider strap 220) is attached to an other one of the shoulder straps at a third point proximate the wearer's shoulder and at a fourth point proximate the wearer's chest on an opposite side of the wearer. A second slider (e.g. slider 230) is functionally coupled to the second slider strap for detachably attaching (e.g. via a buckle 260) to a second holder (e.g. a detachable lanyard 850 as described below with regard to FIG. 8) and for repositioning said second holder on the second slider strap between said third point and said fourth point. In some embodiments a holder for detachably attaching to the slider (e.g. slider 230) may have a loop to attach the holder to a shoulder weapon (e.g. long gun 290) proximate a stock of the shoulder weapon. In some embodiments a holder for detachably attaching to the slider (e.g. slider 230) may have an attachment mechanism to attach the holder to a hand gun 395. In some embodiments a holder for detachably attaching to the slider (e.g. slider 230) may have a loop to attach the holder to a camera or to a tool proximate a grip of the tool.

Figure 4:
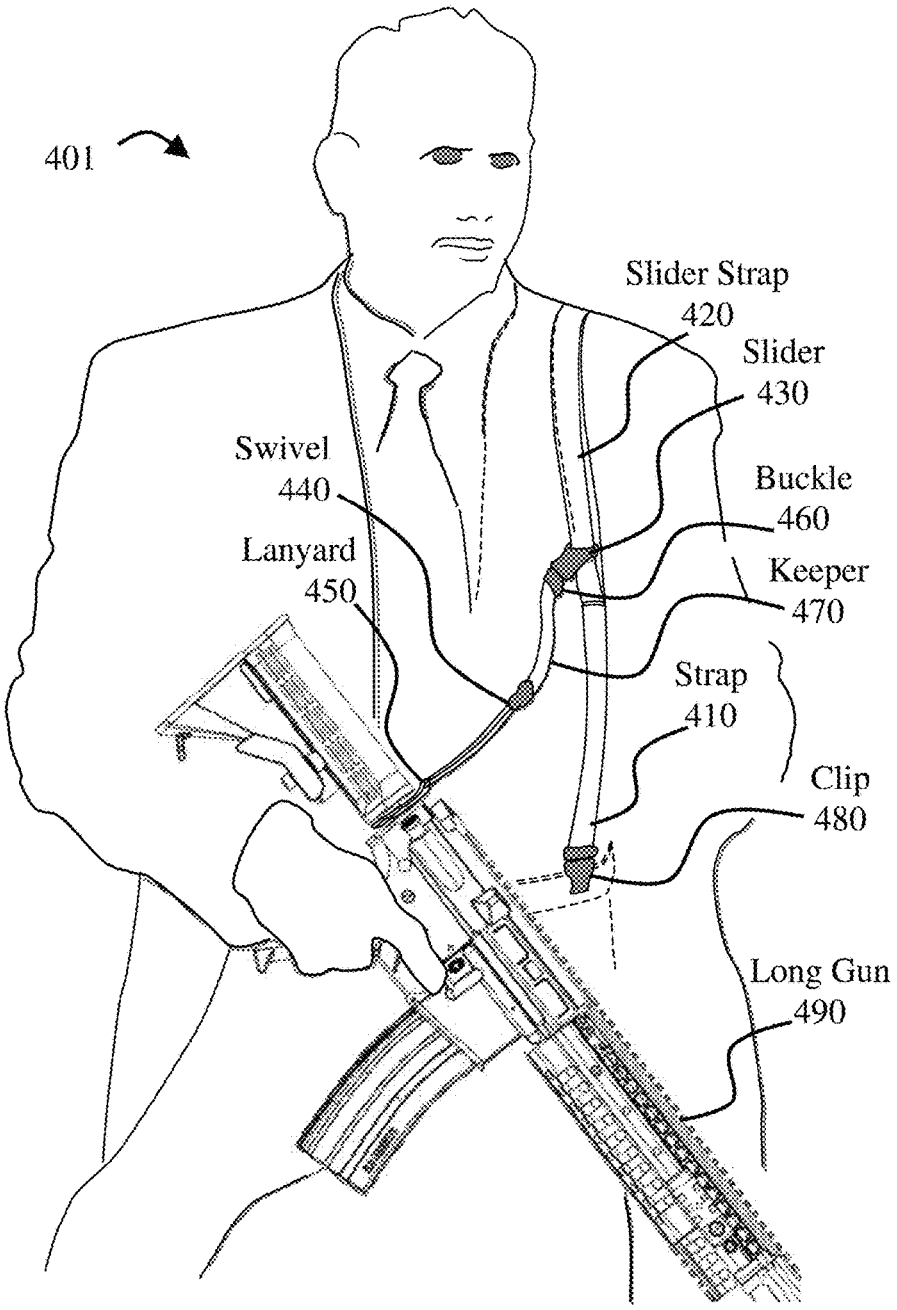
FIG. 4 illustrates one embodiment of a system for a single point sling to facilitate concealed carry of a shoulder weapon or long gun.

FIG. 4 illustrates one embodiment of a system 401 for a single point sling to facilitate concealed carry of a shoulder weapon or long gun 490. The system 401 comprises an elongate extendible first strap portion 410 having an extendible first end and a first end attachment mechanism (e.g. clip 480) coupled with said extendible first end for detachably attaching first strap portion 410 proximate a front belt loop on a support side of a wearer. Embodiments of the system 401 may also comprise a slider strap 420 attached to the first strap portion 410 at a first point proximate the wearer's shoulder and at a second point proximate the wearer's chest. A slider 430 is functionally coupled to slider strap 420 for detachably attaching (e.g. via buckle 460) to a lanyard 450 and for repositioning lanyard 450 on the slider strap 420 between said first point and said second point.

Embodiments of a detachable lanyard 450 may also comprise a length of flexible material in the form of a loop to attach the detachable lanyard to a shoulder weapon or long gun 490 proximate a stock of the shoulder weapon or long gun 490. A swivel 440 is coupled with the length of flexible material, wherein said length of flexible material in some embodiments is being deployed through a flexible tubing conduit (e.g. as described below with regard to FIG. 8, 845). A keeper 470 is coupled to the swivel 440. A quick release attachment mechanism (e.g. buckle 460) is coupled with keeper 470 for detachably attaching the detachable lanyard 450 to slider 430 of a single point sling. Some embodiments of a detachable lanyard 450 may be detachably attached to the slider 430 in a front holstering position to support the shoulder weapon or long gun 490 at the wearer's secondary side under the wearer's arm. Alternatively embodiments of detachable lanyard 450 may be detachably attached to the slider 430 in a back holstering position to support the shoulder weapon proximate the wearer's back.

Figure 5:
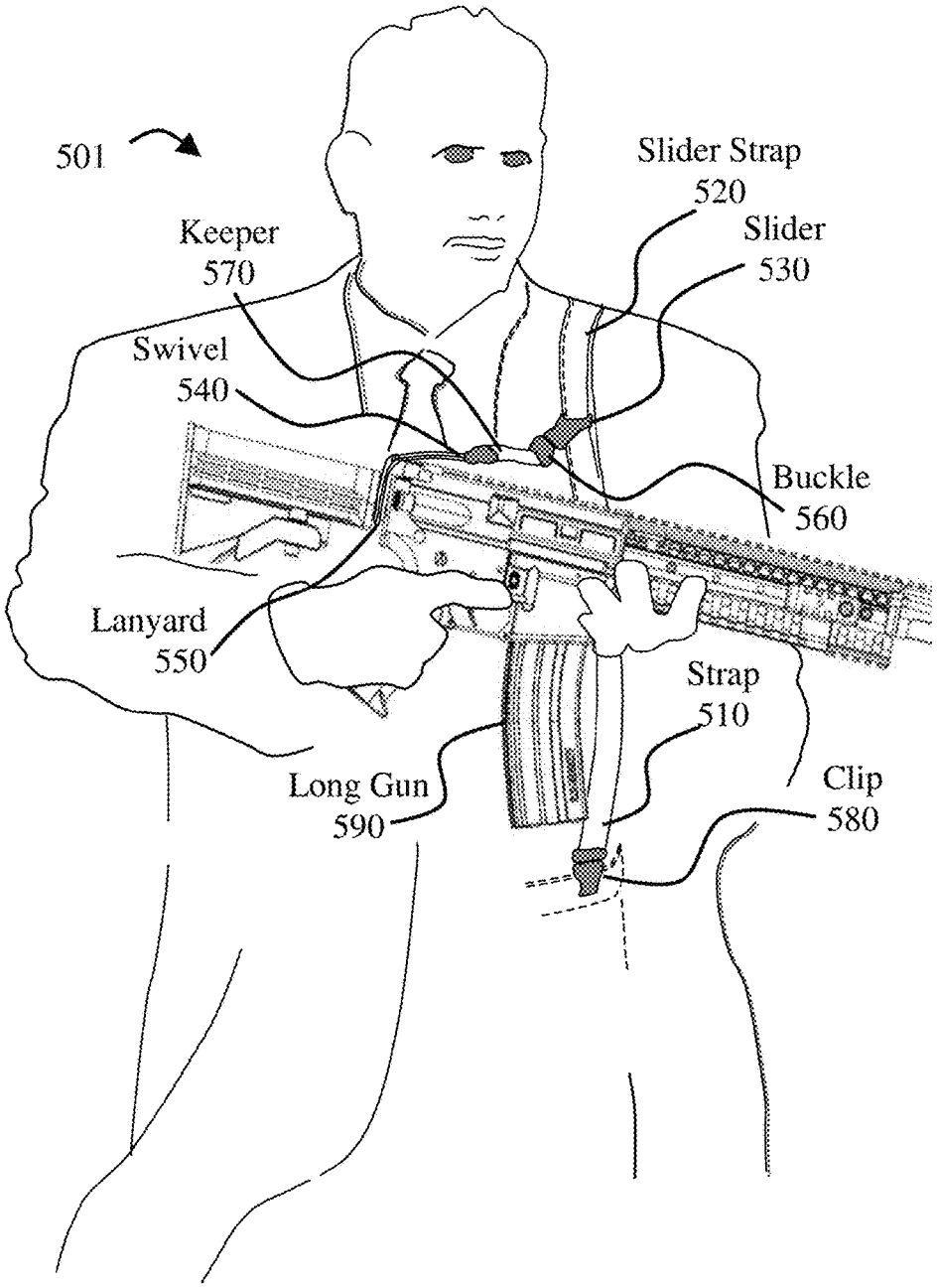
FIG. 5 illustrates one embodiment of shouldering a weapon using a system for a single point sling to facilitate concealed carry of a shoulder weapon or long gun.

FIG. 5 illustrates one embodiment of shouldering a weapon using a system 501 for a single point sling to facilitate concealed carry of a shoulder weapon or long gun 590. Embodiments of the system 501 comprises an elongate extendible first strap portion 510 having a first end attachment mechanism (e.g. clip 580) for detachably attaching first strap portion 510 proximate a front belt loop on a secondary side of a user. Embodiments of the system 501 may also comprise a slider strap 520 attached to the first strap portion 510 at a first point proximate the wearer's shoulder and at a second point proximate the wearer's chest. A slider 530 is functionally coupled to slider strap 520 for detachably attaching (e.g. via buckle 560) to a lanyard 550 and for repositioning lanyard 550 on the slider strap 520 between said first point and said second point. Detachable lanyard 550 may comprise a length of flexible material in the form of a loop to attach the detachable lanyard to a shoulder weapon or long gun 590 proximate a stock of the shoulder weapon or long gun 590. A swivel 540 is coupled with the length of flexible material and a keeper 570 is coupled to the swivel 540. A quick release attachment mechanism (e.g. buckle 560) is coupled with keeper 570 for detachably attaching the detachable lanyard 550 to slider 530 of a single point sling.

In one embodiment a system 501 for a long gun 590 single point sling may be used by first holstering the long gun 590 supported by a loop of lanyard 550 detachably attached (e.g. via buckle 560) to slider 530 in a front holstering position at a secondary side of a user under the user's arm, then drawing the long gun 590 forward, the loop of the lanyard 550 supporting the long gun 590 proximate a stock, a grip or a single point receiver plate mount of the long gun, and shouldering the long gun 590 with the stock against a shoulder of the user, the slider 530 positioned at a shooting position of a slider strap 520 of the single point sling system 501. In some embodiments of system 501 for a long gun single point sling shouldering of the long gun 590 is with the stock against the shoulder at the primary side of the user. In alternative embodiments shouldering of the long gun 590 may be with the stock against the shoulder at the secondary side of the user.

Thus, it will be appreciated that embodiments of the system 501 for a long gun single point sling can support cross-draw capabilities of the user. It will also be appreciated that embodiments of the system 501 may be used to facilitate concealed carry of a shoulder weapon or long gun 590 under a coat or jacket of the user, and that through use of a custom designed collar or lapel, or through being sewn into or integrated into the coat or jacket, may also provide for holstering of the shoulder weapon or long gun 590 in a hands-free carrying position on the back behind the wearer's shoulder.

Figure 6A:
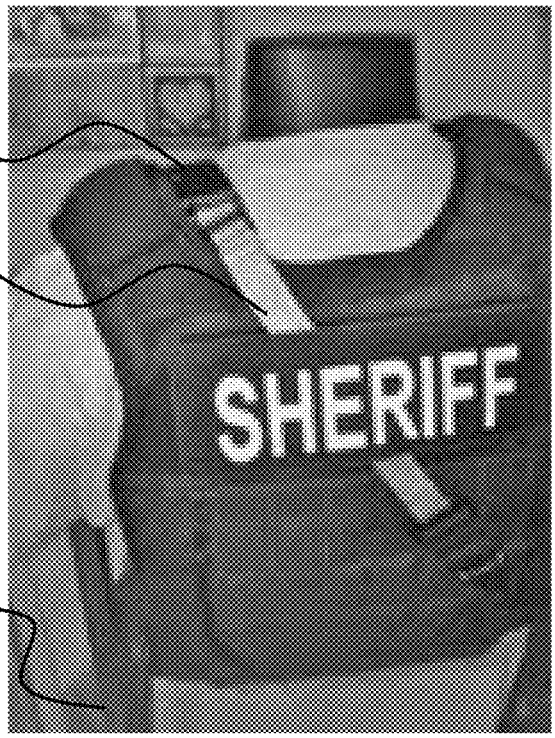
FIG. 6A illustrates a rear view of an alternative embodiment of a system for a shoulder weapon or long gun single point sling.

FIG. 6A illustrates a rear view of an alternative embodiment of a system 601 for a shoulder weapon or long gun 690 single point sling. Embodiments of the system 601 may comprise an elongate extendible rear strap portion 625 having a fixed end and an extendible second end, a first length portion extending from said fixed end to said extendible second end and a second end attachment mechanism coupled with the extendible second end for detachably attaching rear strap portion 625 proximate a back strong side of the wearer. Slider strap 620 is attached to the rear strap portion 625 (e.g. via a central strap portion 115) at the wearer's shoulder.

Figure 6B:
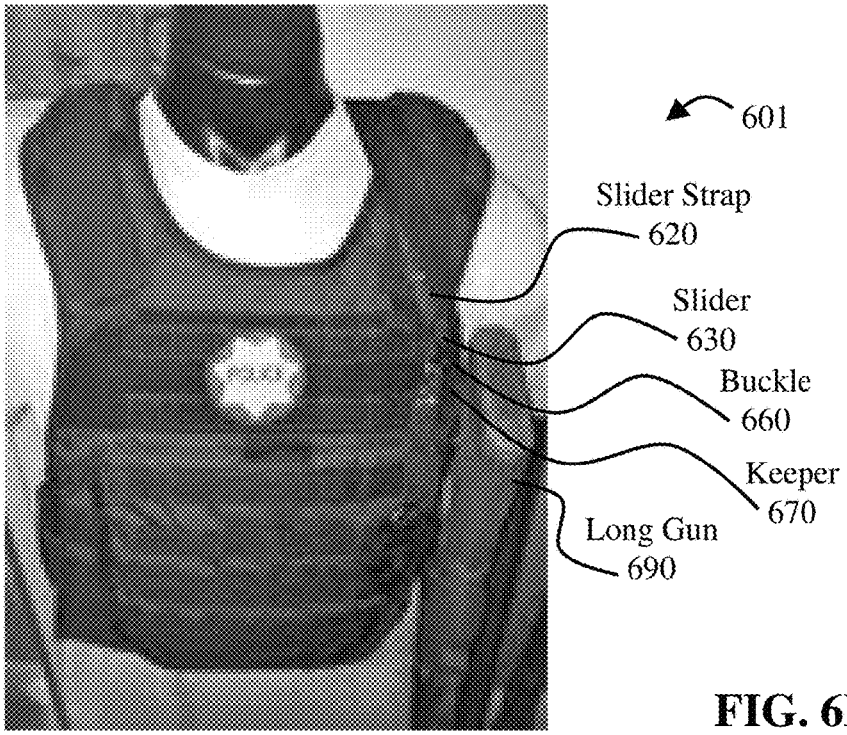
FIG. 6B illustrates a front view of an alternative embodiment of a system for a shoulder weapon or long gun single point sling.

FIG. 6B illustrates a front view of an alternative embodiment of a system 601 for a shoulder weapon or long gun 690 single point sling. In embodiments of the system 601 slider strap 620 may be attached both at a first point proximate the wearer's shoulder and at a second point proximate the wearer's chest. A slider 630 is functionally coupled to slider strap 620 for detachably attaching (e.g. via buckle 660) to a lanyard (e.g. lanyard 850 as described below with regard to FIG. 8) and for repositioning the lanyard on the slider strap 620 between said first point and said second point. A detachable lanyard may comprise a length of flexible material in the form of a loop to attach the detachable lanyard to a shoulder weapon or long gun 690 proximate a stock of the shoulder weapon or long gun 690. A swivel coupled with the length of flexible material and a keeper 670 is coupled to a quick release attachment mechanism (e.g. buckle 660) for detachably attaching the detachable lanyard to slider 630 of a single point sling.

It will be appreciated that embodiments of the system 601 may be sewn into or otherwise integrated into a vest or jacket and therefore, may also provide for holstering of the shoulder weapon or long gun 690 at a hands-free carrying position of slider strap 620 on the back behind the wearer's shoulder.

Figure 7A:
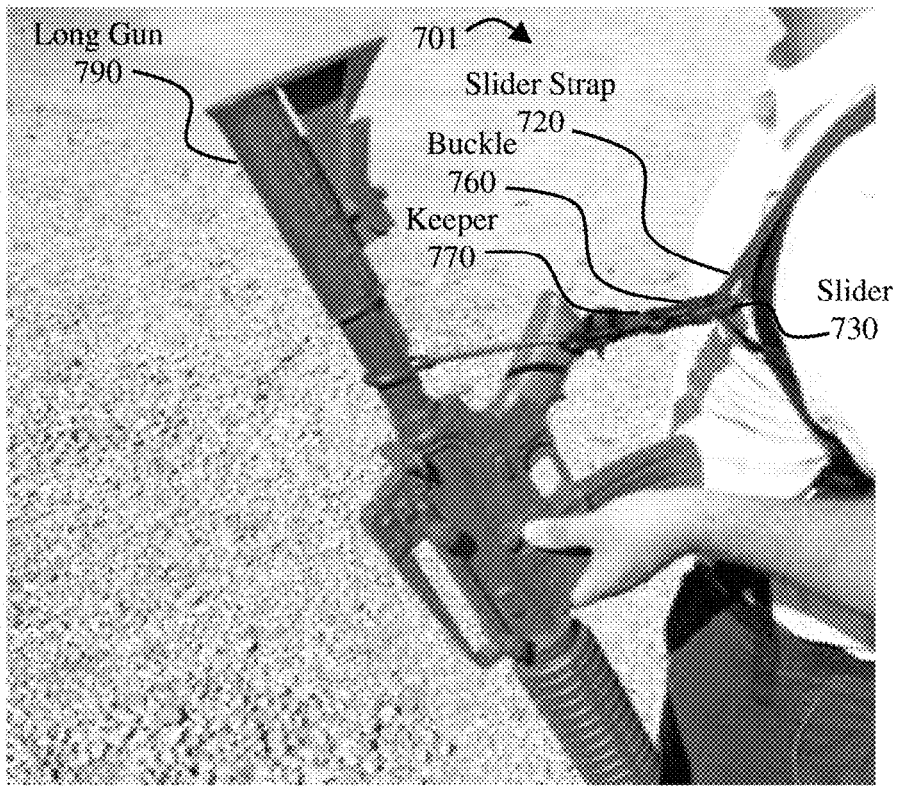
FIG. 7A illustrates one embodiment of drawing a weapon using a system for a shoulder weapon or long gun single point sling.

FIG. 7A illustrates one embodiment of drawing a weapon using a system 701 for a shoulder weapon or long gun 790 single point sling. Embodiments of the system 701 comprises an elongate extendible first strap portion having a slider strap 720 attached to the first strap portion at a first point proximate the wearer's shoulder and at a second point proximate the wearer's chest. A slider 730 is functionally coupled to slider strap 720 for detachably attaching (e.g. via buckle 760) to a lanyard and for repositioning the lanyard on the slider strap 720 between said first point and said second point. A detachable lanyard (e.g. lanyard 850 as described below with regard to FIG. 8) may comprise a length of flexible material in the form of a loop to attach the detachable lanyard to a shoulder weapon or long gun 790 proximate a stock of the shoulder weapon or long gun 790. In some embodiments a loop of the detachable lanyard as shown may comprise a polyarylate superfiber such as VECTRAN (Vectran® is a registered trademark of Kuraray America Inc.). A swivel coupled with the length of flexible material and a keeper 770 is coupled to a quick release attachment mechanism (e.g. buckle 760) for detachably attaching the detachable lanyard to slider 730 of a single point sling.

In one embodiment a system 701 for a long gun 790 single point sling may be used by first holstering the long gun 790 supported by a loop of the lanyard detachably attached (e.g. via buckle 760) to slider 730 in a front holstering position at a secondary side of a user under the user's arm, and then drawing the long gun 790 forward, the loop of the lanyard supporting the long gun 790 proximate a stock, a grip or a single point receiver plate mount of the long gun.

Figure 7B:
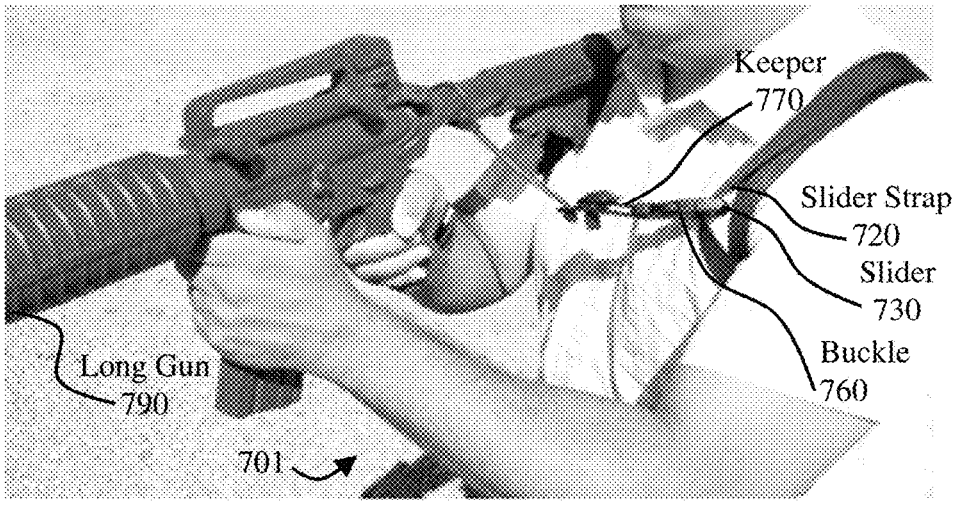
FIG. 7B illustrates one embodiment of shouldering a weapon using a system for a shoulder weapon or long gun single point sling.

FIG. 7B illustrates one embodiment of shouldering a weapon using a system 701 for a shoulder weapon or long gun 790 single point sling. Shouldering the long gun 790 is performed with the stock against a shoulder of the user, the slider 730 positioned at a shooting position of a slider strap 720 of the single point sling system 701. In some embodiments of system 701 for a long gun single point sling, shouldering of the long gun 790 is with the stock against the shoulder at the primary side of the user. In alternative embodiments, shouldering of the long gun 790 may be with the stock against the shoulder at the secondary side of the user. Accordingly, it will be appreciated that embodiments of the system 701 for a shoulder weapon or long gun single point sling can support cross-draw capabilities of the user.

Figure 8:
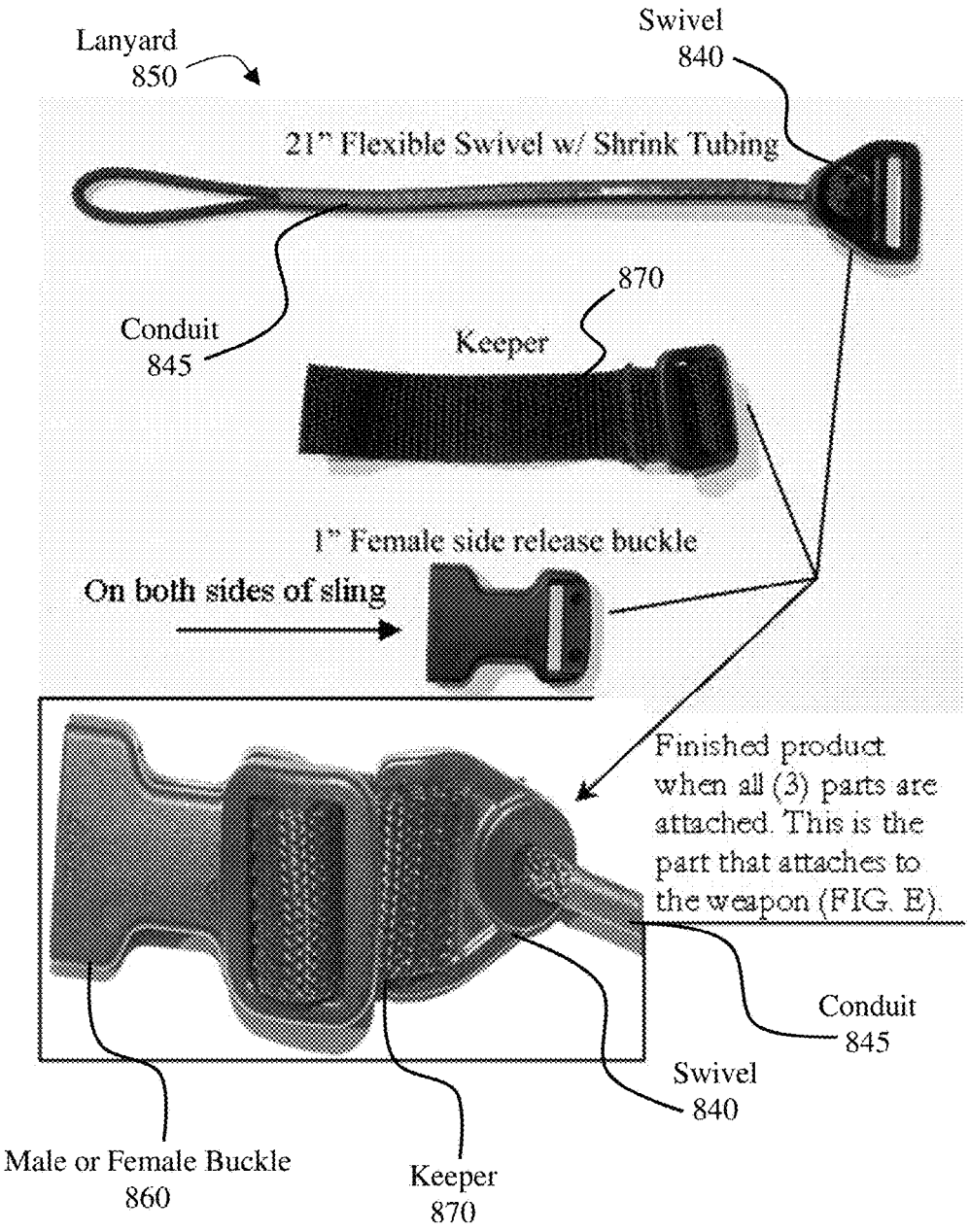
FIG. 8 illustrates one embodiment of a detachable lanyard for use with a system for a shoulder weapon or long gun single point sling.

FIG. 8 illustrates one embodiment of a detachable lanyard 850 for use with a system for a shoulder weapon or long gun single point sling. Embodiments of a detachable lanyard 850 may also comprise a length of flexible material in the form of a loop to attach the detachable lanyard to a shoulder weapon or long gun (e.g. long gun 790) proximate a stock of the shoulder weapon or long gun. In some embodiments a loop of the detachable lanyard 850 may comprise, for example, a polypropylene covered nylon cord or cable. A swivel 840 is coupled with the length of flexible material by a second flexible material, wherein said length of flexible material in some embodiments is being deployed through a flexible tubing conduit 845. In some embodiments swivel 840 comprises a plastic rectangular loop, and the second flexible material may comprise, for example, a stretch elastic webbing, a stretch lycra webbing, a stretch polyester webbing, a stretch canvas webbing, polypropylene webbing or nylon webbing. In some embodiments flexible tubing conduit 845 may comprise, for example, a heat-shrink flexible tubing. A keeper 870 is coupled to the swivel 840. A quick release attachment mechanism (e.g. male or female buckle 860) is coupled with keeper 870 for detachably attaching the detachable lanyard 850 to a slider (e.g. slider 730) of a single point sling apparatus.

In some embodiments detachable lanyard 850 may comprise a length of flexible material, wherein said flexible material is a plastic covered nylon such as BIOTHANE coated webbing (BioThane® is a registered trademark of BioThane Coated Webbing). In some embodiments a loop of the detachable lanyard 850 may comprise a polyarylate superfiber such as VECTRAN (Vectran® is a registered trademark of Kuraray America Inc.).

Figure 9A:
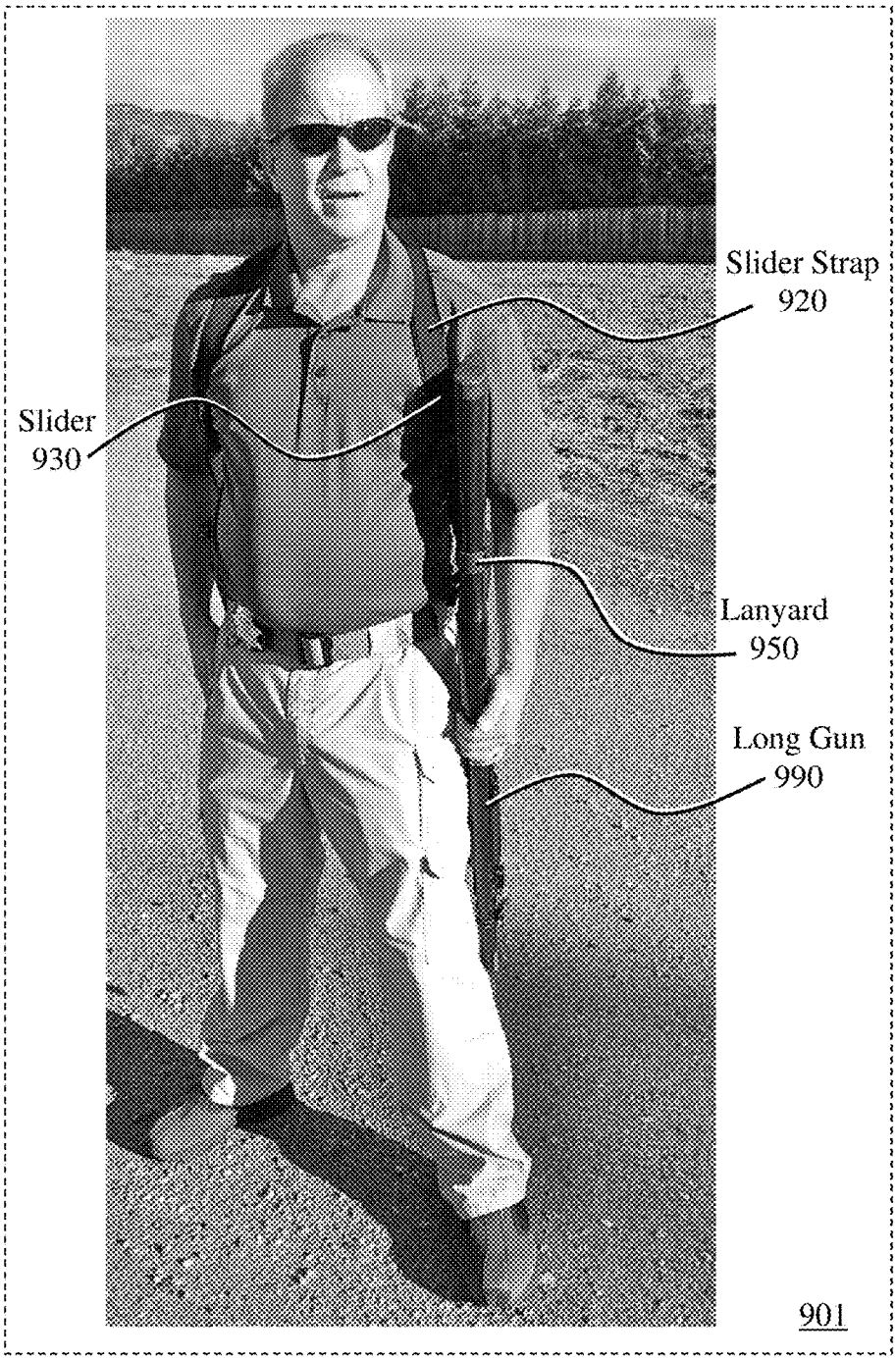
FIG. 9A illustrates one embodiment of holstering a weapon using a system for a shoulder weapon or long gun single point sling.

FIG. 9A illustrates one embodiment of holstering 901 a weapon using a system for a shoulder weapon or long gun 990 single point sling. Embodiments of the system comprise an elongate extendible first strap portion having a slider strap 920 attached to the first strap portion at a first point proximate the wearer's shoulder and at a second point proximate the wearer's chest. A slider 930 is functionally coupled to slider strap 920 for detachably attaching to a lanyard and for repositioning the lanyard on the slider strap 920 between said first point and said second point. Some embodiments of detachable lanyard 950 may comprise a length of flexible material in the form of a loop to attach the detachable lanyard to a shoulder weapon or long gun 990 proximate a stock of the shoulder weapon or long gun 990. In one embodiment a system for a long gun 990 single point sling may be used by first holstering 901 the long gun 990 supported by a loop of the lanyard 950 detachably attached to slider 930 in a front holstering position at a secondary side of a user under the user's arm. It will be appreciated that in some embodiments of a system for a long gun single point sling, holstering 901 of the long gun 990 is in a front holstering position at the secondary side of the user, wherein holstering of a hand gun (e.g. hand gun 395 shown in FIG. 9C) may be at the primary side of the user.

Figure 9B:
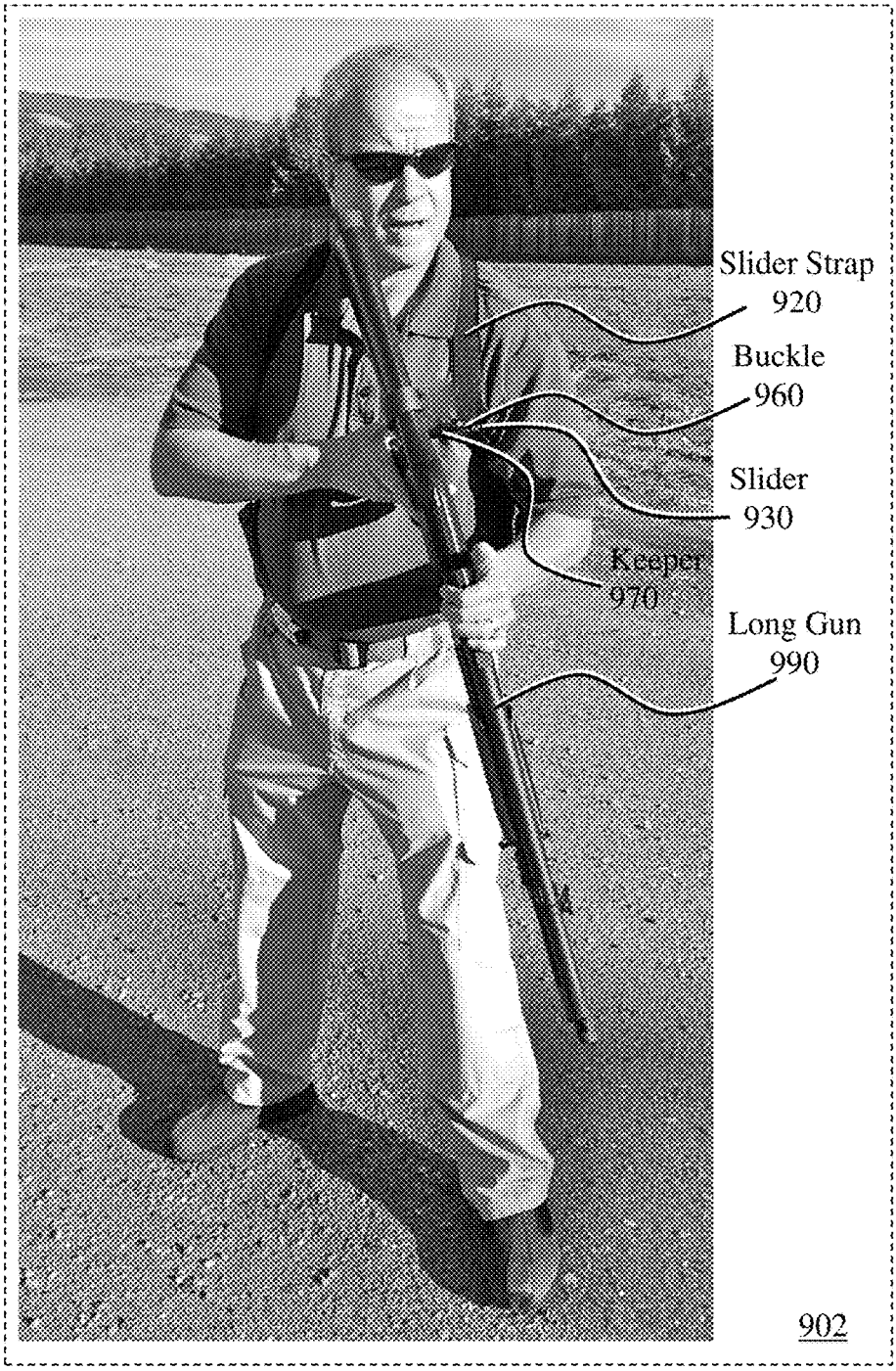
FIG. 9B illustrates one embodiment of drawing a weapon using a system for a shoulder weapon or long gun single point sling.

FIG. 9B illustrates one embodiment of drawing 902 a weapon using a system for a shoulder weapon or long gun 990 single point sling. Embodiments of the system comprise a swivel coupled with the length of flexible material and a keeper 970 is coupled to a quick release attachment mechanism (e.g. buckle 960) for detachably attaching the detachable lanyard to slider 930 on slider strap 920 of the single point sling apparatus. In one embodiment the system for a long gun 990 single point sling may further be used by next drawing 902 the long gun 990 forward, the loop of the lanyard 950 supporting the long gun 990 proximate a stock, a grip or a single point receiver plate mount of the long gun.

Figure 9C:
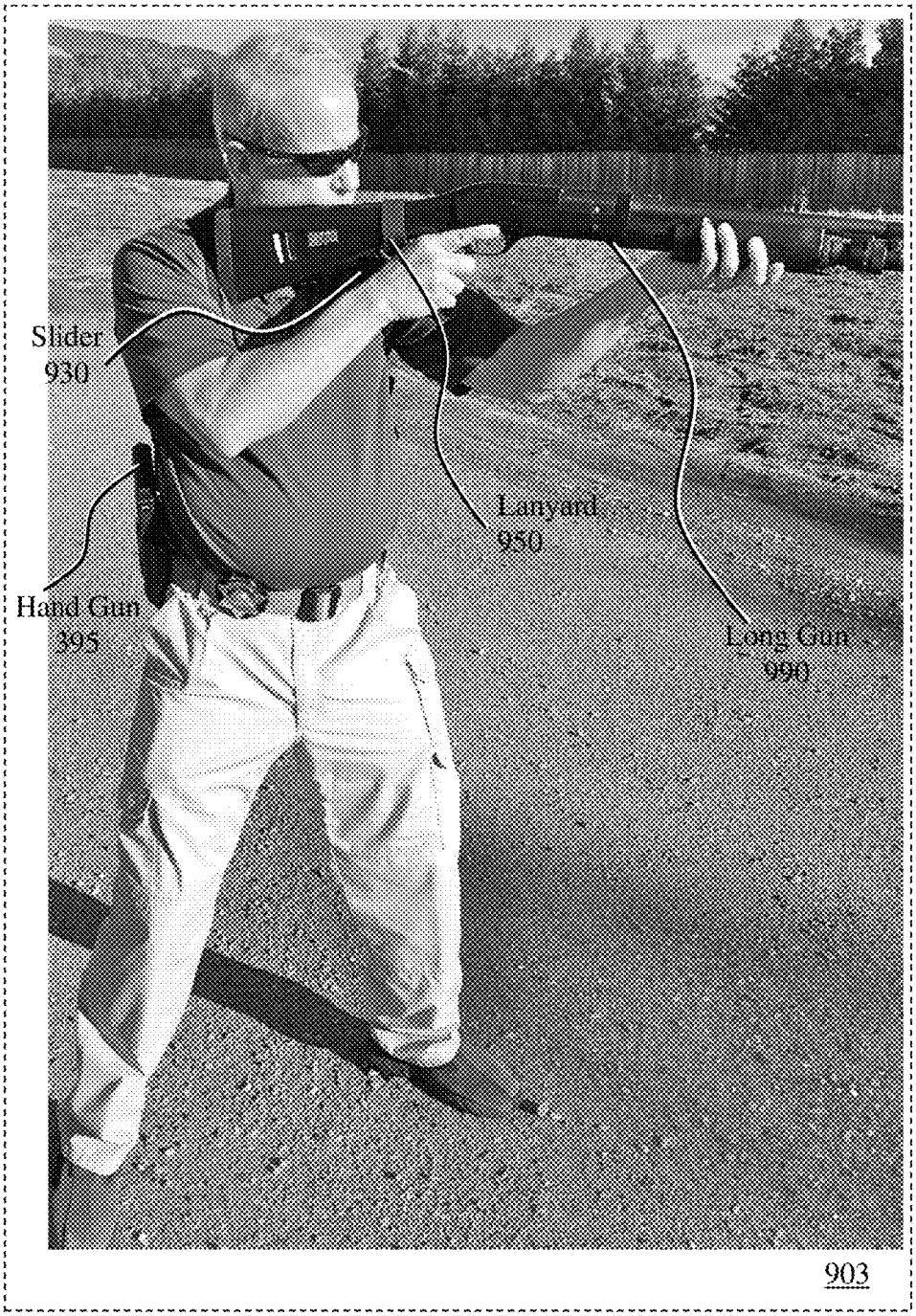
FIG. 9C illustrates one embodiment of shouldering a weapon using a system for a shoulder weapon or long gun single point sling.

FIG. 9C illustrates one embodiment of shouldering 903 a weapon using a system for a shoulder weapon or long gun 990 single point sling. In one embodiment the system for a long gun 990 single point sling may further be used by next shouldering 903 the long gun 990 with the stock against a shoulder of the user, the slider 930 positioned at a shooting position of slider strap 920 of the single point sling apparatus. In some embodiments of a system for a long gun single point sling, shouldering 903 of the long gun 990 is with the stock against the shoulder at the primary side of the user. In alternative embodiments, shouldering of the long gun 990 may be with the stock against the shoulder at the secondary side of the user. Accordingly, it will be appreciated that embodiments of the system for a shoulder weapon or long gun single point sling herein disclosed can support cross-draw capabilities of the user.

In some embodiments detachable lanyard 950 may comprise a length of flexible material, wherein said flexible material is a plastic covered nylon such as BIOTHANE coated webbing (BioThane® is a registered trademark of BioThane Coated Webbing). It will also be appreciated that a uniform process for using some variety of shoulder weapons and/or long guns may be established through embodiments of the single point sling systems herein disclosed.

Figure 10A:
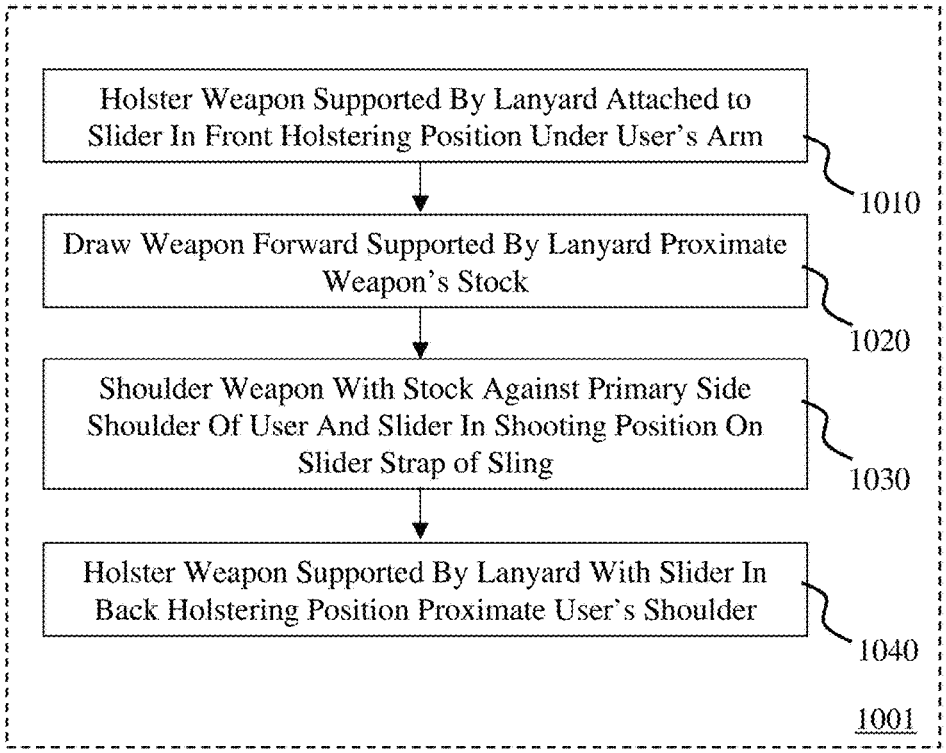
FIG. 10A illustrates one embodiment of a process using a system for a shoulder weapon or long gun single point sling.

FIG. 10A illustrates one embodiment of a process 1001 using a system for a shoulder weapon or long gun single point sling. In one embodiment a system for a shoulder weapon or long gun single point sling may be used, in step 1010, by holstering (e.g. as shown in FIG. 9A, 901) the long gun (e.g. long gun 790 or 990) supported by a loop of a lanyard detachably attached to a slider (e.g. slider 730 or 930) in a front holstering position at a secondary side of a user under the user's arm. Next in step 1020, drawing (e.g. as shown in FIG. 7A or FIG. 9B, 902) the long gun forward may be performed, with the loop of the lanyard supporting the long gun proximate a stock (or a grip or a single point receiver plate mount) of the long gun. Next in step 1030, shouldering (e.g. as shown in FIG. 7B or FIG. 9C, 903) the long gun may be performed, with the stock against a shoulder of the user, the slider positioned at a shooting position of a slider strap (e.g. slider strap 720 or 920) of the single point sling. In some embodiments of step 1030, shouldering of the long gun is with the stock against the shoulder at the primary side of the user. Finally in step 1040, holstering the long gun (e.g. long gun 790 or 990) may be performed, supported by the lanyard with the slider positioned at a back holstering position proximate the user's shoulder. It will be appreciated that while additional holstering equipment is not shown in embodiments of single point sling systems herein disclosed, and may not be necessary for the use of single point sling systems herein disclosed, inclusion of such additional holstering equipment is anticipated and the invention is not to be limited to the specific constructions and arrangements shown and described herein.

Figure 10B:
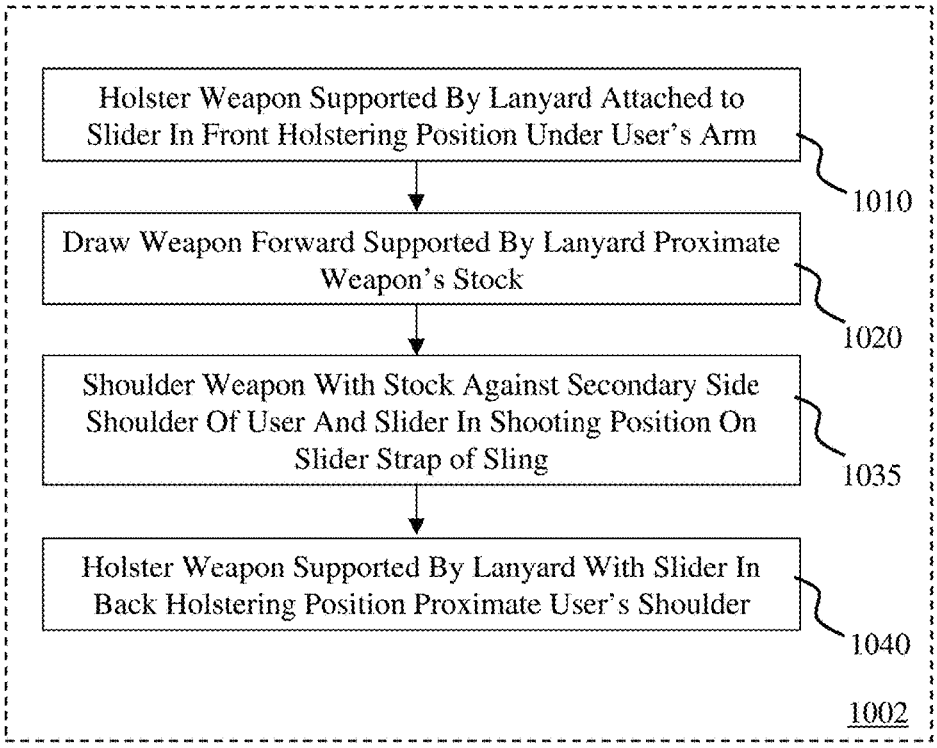
FIG. 10B illustrates an alternative embodiment of a process using a system for a shoulder weapon or long gun single point sling.

FIG. 10B illustrates an alternative embodiment of a process using a system for a shoulder weapon or long gun single point sling. In one embodiment a system for a shoulder weapon or long gun single point sling may be used, in step 1010, by holstering (e.g. as shown in FIG. 9A, 901) the long gun supported by a loop of a lanyard detachably attached to a slider in a front holstering position at a secondary side of a user under the user's arm. Next in step 1020, drawing (e.g. as shown in FIG. 7A or FIG. 9B, 902) the long gun forward may be performed, with the loop of the lanyard supporting the long gun proximate a stock (or a grip or a single point receiver plate mount) of the long gun. Next in step 1035, shouldering the long gun may be performed, with the stock against a shoulder of the user, the slider positioned at a shooting position of a slider strap of the single point sling. In embodiments of step 1035 shouldering of the long gun may be with the stock against the secondary side shoulder of the user. Finally in step 1040, holstering the long gun may be performed, supported by the lanyard with the slider positioned at a back holstering position proximate the user's shoulder.

Figure 11:
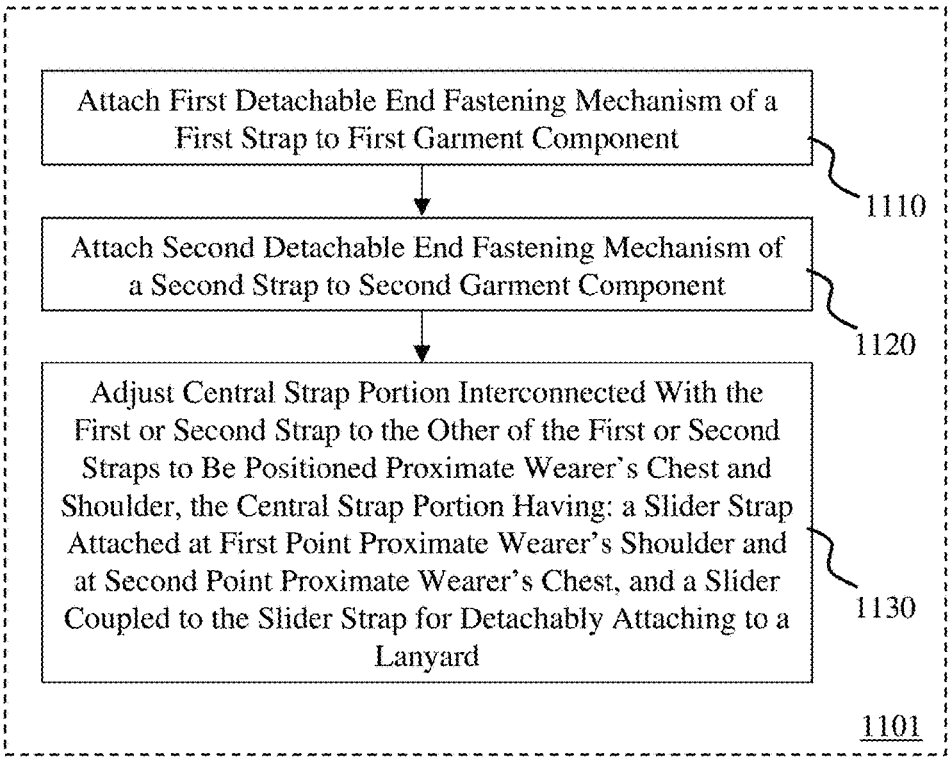
FIG. 11 illustrates one embodiment of a process for adjustably attaching a system for a shoulder weapon single point sling into a garment.

FIG. 11 illustrates one embodiment of a process 1101 for adjustably attaching a system for a shoulder weapon single point sling into a garment. At step 1110 a first detachable end fastening mechanism, coupled with a first strap of a first flexible material, is attached to a first component of a garment. At step 1120 a second detachable end fastening mechanism, coupled with a second strap of a second flexible material, is attached to a second component of the garment. Then at step 1130 a central strap portion interconnected with said first or second straps to the other of said first or second straps, is adjusted to be positioned proximate the wearer's chest and shoulder, the central strap portion having: a slider strap attached to the central strap portion at a first point proximate the wearer's shoulder and at a second point proximate the wearer's chest, and a slider coupled to the slider strap for detachably attaching to a lanyard.

It will also be appreciated that embodiments of the process 1101 for adjustably attaching a system for a shoulder weapon single point sling into a garment may be used to facilitate concealed carry of a shoulder weapon or long gun under a coat or jacket of the wearer. It will also be appreciated that some embodiments of the process 1101 for adjustably attaching a system for a shoulder weapon single point sling into a garment may also serve to provide functional suspenders to support the weight of a duty belt.

Methods, systems, and apparatus have been disclosed to provide multiple-position slings and hands-free carrying devices for equipment, hand guns, long guns, shoulder weapons and military style tactical firearms or other devices. For example, embodiments of systems and apparatus herein disclosed may provide for holstering of a long gun in a hands-free carrying position on the back behind the wearer's shoulder. Some embodiments of the systems and apparatus for a long gun single point sling herein disclosed may support the cross-draw capabilities of a user. Some embodiments of the systems and apparatus herein disclosed may also serve as functional suspenders to support the weight of a duty belt. Some embodiments of systems and apparatus herein disclosed for a long gun single point sling may be sewn into or otherwise integrated into a coat, vest or jacket and therefore, may also provide for holstering of the shoulder weapon or long gun at a hands-free carrying position on the back of the coat, vest or jacket behind the wearer's shoulder. It will also be appreciated that through embodiments of systems and apparatus herein disclosed for a long gun single point sling, uniform processes for using some variety of shoulder weapons and/or long guns may be established and taught with applicability to some variety of shoulder weapons and/or long guns.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art upon studying this disclosure. Thus, the disclosed embodiments may be readily modifiable in arrangement and detail without departing from the principles of the present disclosure or the scope of the accompanying claims.

What is claimed is:

1. A sling system comprising:

a hands free carrying apparatus comprising:

a shoulder strap portion;

a slider strap attached to the shoulder strap portion at a first point proximate a wearer's shoulder and at a second point proximate the wearer's chest;

a slider functionally coupled to the slider strap detachably attached to a holder for repositioning said holder on the slider strap during use between said first and second points, wherein said holder comprises a detachable lanyard and said detachable lanyard comprises:

a first length of a first flexible material in the form of a loop to attach the detachable lanyard to a shoulder weapon proximate a stock of the shoulder weapon;

a swivel coupled with the first length of the first flexible material, said first length of the first flexible material being deployed through a flexible tubing conduit;

a keeper to couple to the swivel; and a quick release attachment mechanism coupled with said keeper for detachably attaching the detachable lanyard to the slider.

2. The sling system of claim 1, wherein said first flexible material comprises a polyarylate superfiber.

3. The sling system of claim 1, wherein said first flexible material comprises a polypropylene covered nylon cord or cable.

4. The sling system of claim 1, wherein said flexible tubing conduit comprises a heat-shrink flexible tubing.

5. The sling system of claim 1 wherein the shoulder strap portion and/or the detachable lanyard comprises a plastic covered nylon webbing.

6. The sling system of claim 1, said detachable lanyard being detachably attached to the slider in a front holstering position to support a shoulder weapon at the wearer's secondary side under the wearer's arm.

7. The sling system of claim 6, said detachable lanyard being detachably attached to the slider in a back holstering position to support the shoulder weapon proximate the wearer's back.

8. The sling system of claim 1, comprising:

a second slider strap attached to the shoulder strap portion at a third point proximate the wearer's shoulder and at a fourth point proximate the wearer's chest on the strong side of the wearer; and a second slider functionally coupled to the second slider strap detachably attached to a second lanyard for repositioning said second lanyard on the second slider strap between said third point and said fourth point.

9. The sling system of claim 8, wherein said second lanyard is for detachably attaching to the second slider having an attachment mechanism to attach the holder to a hand gun.

10. An apparatus comprising:

a back crossing pair of shoulder straps;

a slider strap attached to one of the shoulder straps at a first point proximate a wearer's shoulder and at a second point proximate the wearer's chest; and a slider coupled to the slider strap detachably attached to a holder for repositioning said holder on the slider strap during use between said first and said second points, wherein said holder comprises a detachable lanyard and said detachable lanyard comprises:

a first length of a first flexible material in the form of a loop to attach the detachable lanyard to a shoulder weapon proximate a stock of the shoulder weapon;

a swivel coupled with the first length of the first flexible material, said first length of the first flexible material being deployed through a flexible tubing conduit;

a keeper to couple to the swivel; and a quick release attachment mechanism coupled with said keeper for detachably attaching the detachable lanyard to the slider.

11. The apparatus of claim 10, comprising:

a second slider strap attached to an other one of the shoulder straps at a third point proximate and nearest to the wearer's shoulder and at a fourth point proximate and nearest to the wearer's chest on an opposite side of the wearer; and a second slider functionally coupled to the second slider strap detachably attached to a second holder for repositioning said second holder on the second slider strap between said third point and said fourth point.

12. The apparatus of claim 11, wherein said second holder comprises a second detachable lanyard.

13. The apparatus of claim 12, wherein said second holder is for detachably attaching to the second slider having a loop to attach the second holder to a tool proximate a grip of the tool.

14. The apparatus of claim 12, wherein said second holder is for detachably attaching to the second slider having a loop to attach the second holder to a camera.

15. The apparatus of claim 12, wherein said second holder is for detachably attaching to the second slider having an attachment mechanism to attach the second holder to a hand gun.

16. The apparatus of claim 10, wherein said first flexible material comprises a polyarylate superfiber.

17. The apparatus of claim 10, wherein said first flexible material comprises a polypropylene covered nylon cord or cable.

18. The apparatus of claim 10, wherein said flexible tubing conduit comprises a heat-shrink flexible tubing.

19. The apparatus of claim 10 wherein the shoulder straps and/or the detachable lanyard comprises a BIOTHANE plastic coated nylon webbing.

20. A method for adjustably attaching a system for a shoulder weapon single point sling into a garment, comprising:

attaching a first detachable end fastening mechanism, coupled with a first strap of a first flexible material, to a first component of a garment;

attaching a second detachable end fastening mechanism, coupled with a second strap of a second flexible material, to a second component of the garment; and adjusting a central strap portion, interconnected with one of said first or second straps and extending to the other one of said first or second straps, to be positioned proximate the wearer's chest and shoulder, said central strap portion having:

a slider strap attached to the central strap portion at a first point proximate the wearer's shoulder and at a second point proximate the wearer's chest, and a slider coupled to the slider strap detachably attached to a lanyard for repositioning said lanyard on the slider strap during use between said first and said second points, wherein said lanyard comprises:

a first length of a first flexible material in the form of a loop to attach the detachable lanyard to a shoulder weapon proximate a stock of the shoulder weapon;

a swivel coupled with the first length of the first flexible material, said first length of the first flexible material being deployed through a flexible tubing conduit;

a keeper to couple to the swivel; and a quick release attachment mechanism coupled with said keeper for detachably attaching the detachable lanyard to the slider.

21. The method of claim 20, wherein the garment is a jacket.

22. The method of claim 20, wherein the first component of the garment is a belt.

23. A system for a shoulder weapon single point sling, comprising:

an elongate extendible first strap portion said first strap portion having an extendible first end and a first end attachment mechanism coupled with said extendible first end for detachably attaching said strap portion proximate a front belt loop on a support side of a wearer, and an extendible second end and a second end attachment mechanism coupled with said extendible second end for detachably attaching said strap portion proximate a back belt loop on a strong side of the wearer;

a slider strap attached to the first strap portion at a first point proximate the wearer's shoulder and at a second point proximate the wearer's chest; and a slider functionally coupled to the slider strap detachably attached to a lanyard for repositioning said lanyard on the slider strap during use between said first point and said second point, wherein said lanyard comprises:

a first length of a first flexible material in the form of a loop to attach the detachable lanyard to a shoulder weapon proximate a stock of the shoulder weapon;

a swivel coupled with the first length of the first flexible material, said first length of the first flexible material being deployed through a flexible tubing conduit;

a keeper to couple to the swivel; and a quick release attachment mechanism coupled with said keeper for detachably attaching the detachable lanyard to the slider.

24. The system of claim 23, said lanyard detachably attached to the slider in a front holstering position to support the shoulder weapon at the wearer's secondary side under the wearer's arm.

25. The system of claim 23, said lanyard for detachably attaching to the slider in a back holstering position to support the shoulder weapon proximate the wearer's back.

* * * * *